US005162088A

United States Patent [19]

Peng et al.

[11] Patent Number: 5,162,088

[45] Date of Patent: Nov. 10, 1992

[54] EVAPORATOR APPARATUS

[75] Inventors: Johnson Peng, Taipei, Taiwan; Bernard Chiu, Ashland, Mass.

[73] Assignee: Duracraft Corporation, Sudbury, Mass.

[21] Appl. No.: 756,941

[22] Filed: Sep. 9, 1991

[51] Int. Cl.[5] ..... B01F 3/04

[52] U.S. Cl. ..... 261/27; 261/29; 261/107; 261/72.1

[58] Field of Search ..... 261/27, 29, 107, 104, 261/72.1

[56] References Cited

U.S. PATENT DOCUMENTS

| | | | |
|---|---|---|---|
| 1,464,401 | 8/1923 | Bennett | 261/107 |
| 1,853,420 | 4/1932 | Harris | 261/107 |
| 1,883,778 | 10/1932 | Freeman | 261/104 |
| 1,945,464 | 1/1934 | Thomas | 261/29 |
| 2,002,273 | 5/1935 | Parker et al. | 261/104 |
| 2,966,046 | 12/1960 | Wright | 261/DIG. 4 |
| 2,998,714 | 9/1961 | Bonzer | 261/DIG. 4 |
| 3,179,386 | 4/1965 | Liebmann | 261/29 |
| 3,322,405 | 5/1967 | Knudson et al. | 261/29 |
| 3,977,364 | 8/1976 | Gijsbers et al. | 261/107 |
| 5,037,583 | 8/1991 | Hand | 261/107 |

*Primary Examiner*—Tim Miles

*Attorney, Agent, or Firm*—John E. Toupal; Harold G. Jarcho

[57] ABSTRACT

An evaporator including a housing defining an air inlet, an air outlet, and a reservoir for a liquid supply; a blower for producing air flow in a path between the inlet and the outlet; a vessel retained by the housing above the reservoir and adapted to retain a liquid volume; a wick means retained by the vessel and comprising a source portion submerged in the liquid volume and an evaporative portion disposed in the air flow path, the wick means adapted to provide by capillary action liquid flow from the source portion to the evaporative portion; and a pump means for pumping liquid from the reservoir to the vessel so as to maintain the liquid volume therein. The output capacity of the evaporator is increased by pumping liquid from a reservoir upwardly to a supply vessel.

34 Claims, 5 Drawing Sheets

EVAPORATOR APPARATUS

BACKGROUND OF THE INVENTION

This invention relates generally to an evaporator device and, more particularly, to an evaporator device utilizing liquid absorbing wick elements to provide humidification.

Evaporator devices are used extensively to enhance personal comfort by increasing the level of humidity in an enclosed environment. They can function additionally to provide cooling in many hot, dry regions. One well known type of evaporative humidifier employs absorbing wick elements that produce by capillary action liquid flow from a reservoir to wick portions disposed in a path of airflow provided by an electrical blower. One deficiency of wick type evaporators results from the inability of wick elements to draw liquid beyond a maximum height of about six inches. Because of this factor, the effective airflow output of wick type evaporators in cubic feet per minute (CFM) has been limited.

The object of this invention, therefore, is to provide an improved wick type evaporative humidifier exhibiting an increased airflow output.

SUMMARY OF THE INVENTION

The invention is an evaporator including a housing defining an air inlet, an air outlet, and a reservoir for a liquid supply; a blower for producing air flow in a path between the inlet and the outlet; a vessel retained by the housing above the reservoir and adapted to retain a liquid volume; a wick means retained by the vessel and comprising a source portion submerged in the liquid volume and an evaporative portion disposed in the air flow path, the wick means adapted to provide by capillary action liquid flow from the source portion to the evaporative portion; and a pump means for pumping liquid from the reservoir to the vessel so as to maintain the liquid volume therein. The output capacity of the evaporator is increased by pumping liquid from a reservoir upwardly to a supply vessel.

According to specific features of the invention, the vessel comprises a lower vessel retained by the housing above the reservoir and adapted to retain a given portion of the liquid volume, and an upper vessel retained by the housing above the lower vessel and adapted to retain a predetermined portion of the liquid volume; and the wick means comprises a lower wick comprising a lower source portion submerged in the given portion and a lower evaporative portion disposed in the air flow path, and an upper wick comprising an upper source portion submerged in the predetermined portion and an upper evaporative portion disposed in the air flow path. Evaporative capacity is further enhanced by the provision of upper and lower vessels and wicks.

According to other features of the invention, the pump means comprises a feed tube for circulating liquid from the reservoir to the upper vessel, the upper vessel defines an upper overflow for discharging by gravity liquid into the lower vessel so as to maintain the predetermined portion in the upper vessel, and the lower vessel defines a lower overflow for discharging liquid by gravity into the reservoir so as to maintain the given portion in the lower vessel. This structural arrangement simplifies the feed of liquid to the upper and lower vessels.

According to still other features of the invention, the housing comprises an outlet sidewall having outlet openings defining the outlet, the outlet sidewall is adapted for pivotal movement between open and closed positions, and the upper and lower vessels are supported by the outlet sidewall for pivotal movement therewith. The pivotal sidewall facilitates access to the wick elements retained by the upper and lower vessels.

According to a further feature of the invention, the outlet sidewall, the upper vessel and the lower vessel are removable as a unit from the housing. This structural arrangement simplifies servicing of the wick elements.

According to yet another feature of the invention, the housing further defines a tray disposed above the upper vessel, a drain providing liquid communication between the tray and the upper evaporative portion of the upper wick, and a top wall movable into an open position to provide access to the tray. The cooling effect of the evaporator is enhanced by depositing in the tray ice that melts and feeds cold water to the upper evaporative portion.

According to additional features, the housing further defines a removable container defining the reservoir and a sidewall door providing access thereto, and the invention includes a removable tank accessible through the sidewall door and adapted for filling with liquid, and a valve for discharging liquid retained by the tank into the container. The removable container simplifies cleaning thereof and the removable tank simplifies filling of the container reservoir.

According to further features of the invention, the valve is a check valve having an actuator stem, the tank comprises a bottom wall retaining the check valve with the actuator stem projecting outwardly therefrom, and the container further defines support means shaped and arranged to support the tank in an inclined position with the bottom wall facing downwardly and an actuator surface disposed to engage the actuator stem and induce discharge of liquid retained by the tank. These structural features facilitate and insure automatic discharge of liquid from the tank into the reservoir container.

According to important features of the invention, the pump means comprises a pump pivotally supported in the container by the housing and pivotable into a position out of the container so as to permit removal thereof through the sidewall door, a switch functional to either energize or deenergize the pump, and a float operatively coupled to the switch and pivotable with the pump, the float is operable to cause energization of the pump in response to a given minimum liquid level in the reservoir and to cause deenergization of the pump in response to either a level of liquid in the reservoir less than the given level or pivotal movement of the pump out of the container. These features insure proper and safe operation of the pump and permit removal of the container from the housing.

According to other features of the invention, the bottom wall of the tank defines a recess accommodating the pump, and an end of the tank opposite to the bottom wall defines a handle. The recess permits a compact arrangement of components and the handle facilitates handling of the removable tank.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
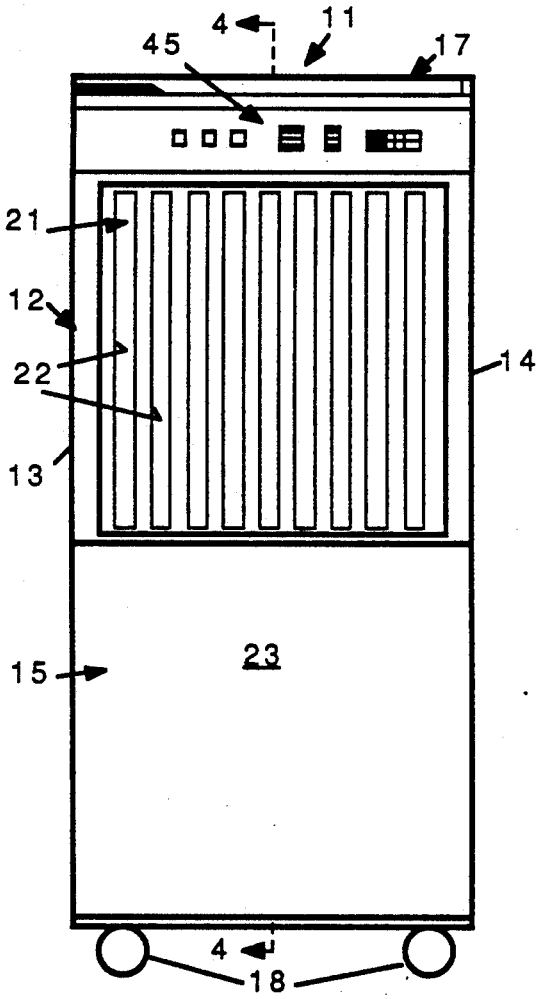
FIG. 1 is a front elevational view of a evaporative humidifier according to the invention.
Figure 2:
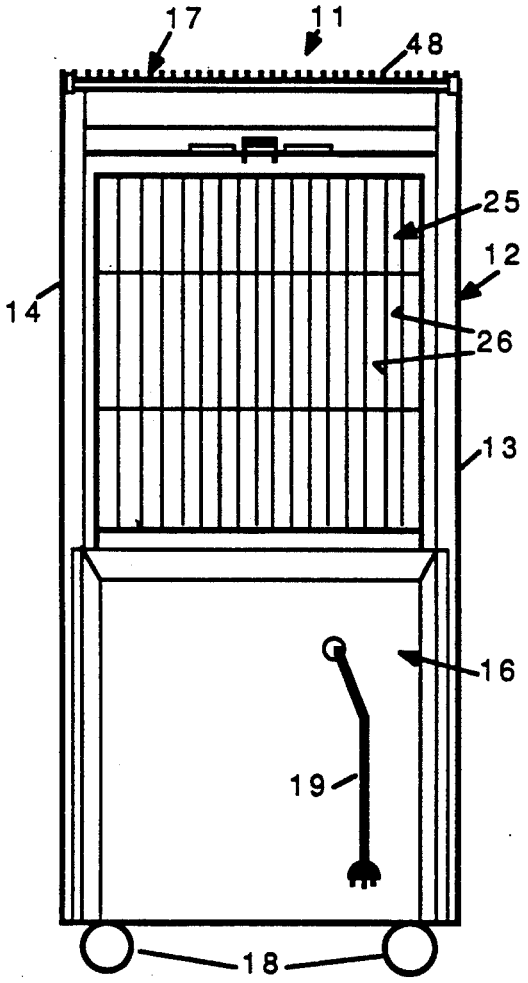
FIG. 2 is a rear elevational view of the humidifier shown in FIG. 1.

An evaporator 11 includes a housing 12 having sidewalls 13, 14, a front sidewall 5, a rear sidewall 16 and a top wall 17. Supporting the housing 12 are a plurality of rollers 18. A power cord 19 for connection in a suitable household outlet (not shown) extends out of the rear sidewall 16. Included in the front sidewall 15 is an upper inlet portion 21 defining a plurality of inlet openings 22. Also included in the front sidewall 15 is a door 23. The rear sidewall 16 includes an outlet portion 25 that defines a plurality of outlet openings 26.

Figure 4:
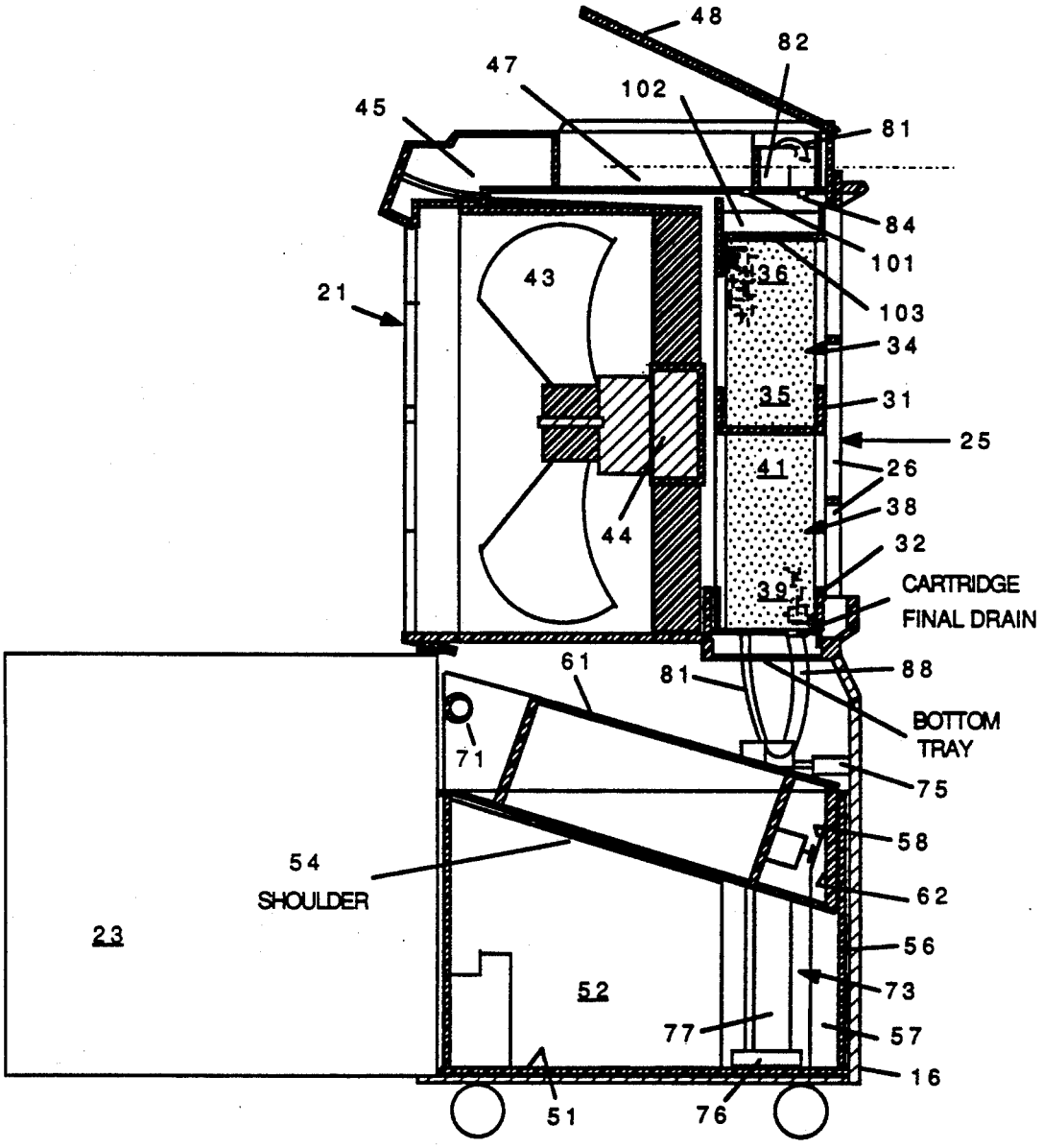
FIG. 4 is a cross sectional view of the humidifier taken along the lines 4—4 of FIG. 1.
Figure 5:
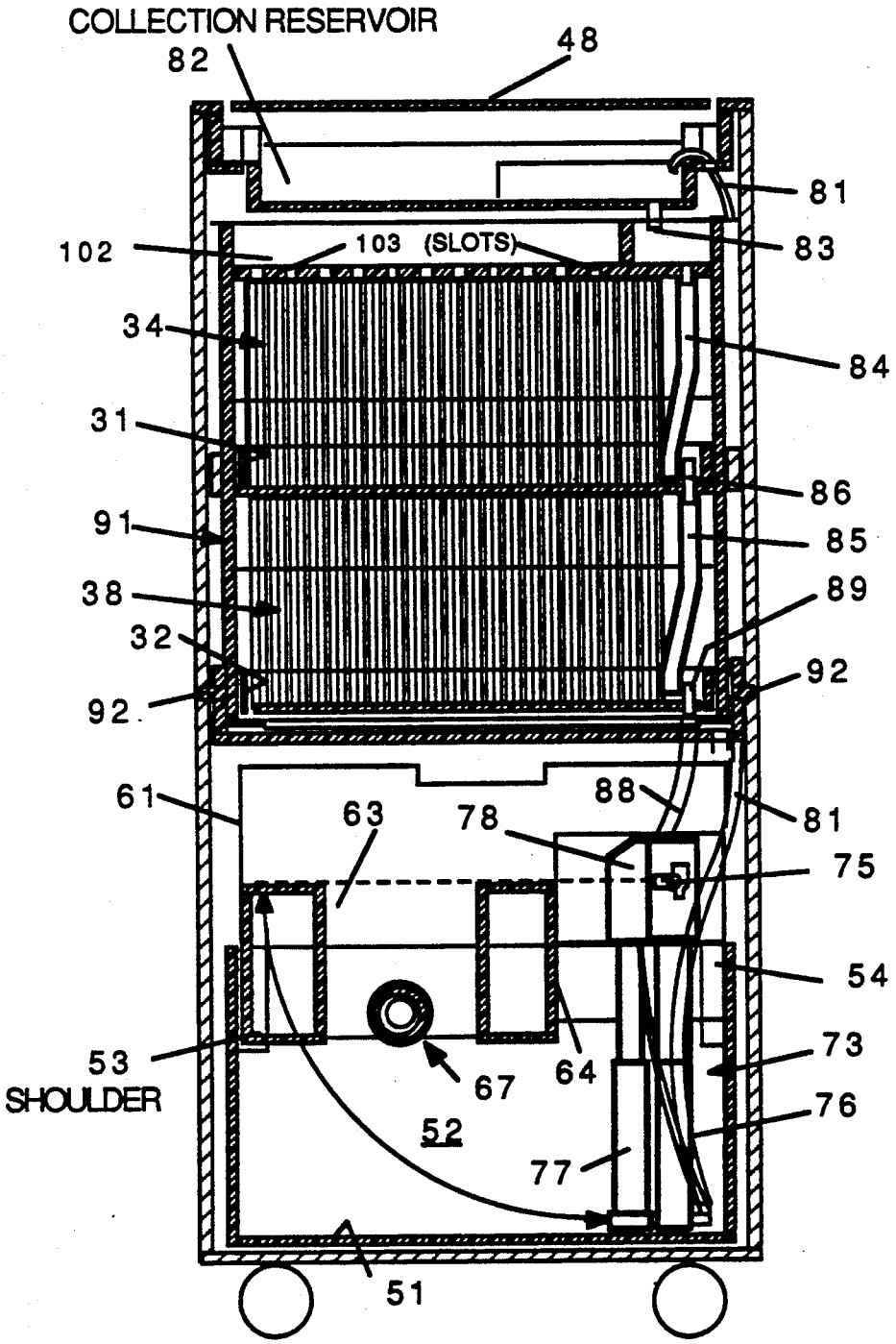
FIG. 5 is a cross sectional view taken along lines 5—5 of FIG. 3.

As shown in FIGS. 4 and 5, the outlet portion 25 of the rear sidewall 16 supports in a vertically stacked arrangement an upper trough vessel 31 and a lower trough vessel 32. Retained by the upper trough 31 is an upper wick cartridge 34 having a source portion 35 disposed in the trough 31 and an evaporative portion 36 projecting upwardly therefrom. Similarly, the lower trough 32 retains a lower wick cartridge 38 having a source portion 39 within the trough 32 and an evaporative portion 41 projecting upwardly therefrom. A blower fan 43 is supported within the housing 12 between the inlet 21 and the outlet 25. Rotatably coupled to the fan 43 is an electrical motor 44 connected to a conventional electrical control section 45 retained in an upper front portion of the housing 12. When energized, the motor 44 produces rotation of the fan 43 to produce airflow between inlet 21 and the outlet 25 in a path that includes the upper evaporative portion 36 of the upper wick cartridge 34 and the lower evaporative portion 41 of the lower wick cartridge 38. Also retained in the upper portion of the housing 12 behind the electrical control section 45 is an open tray 47 that is disposed above the upper wick cartridge 34. Covering the tray 47 is a lid portion 48 of the top wall 17. The lid 48 can be opened as shown in FIG. 4 to provide access to the tray 47.

Figure 6:
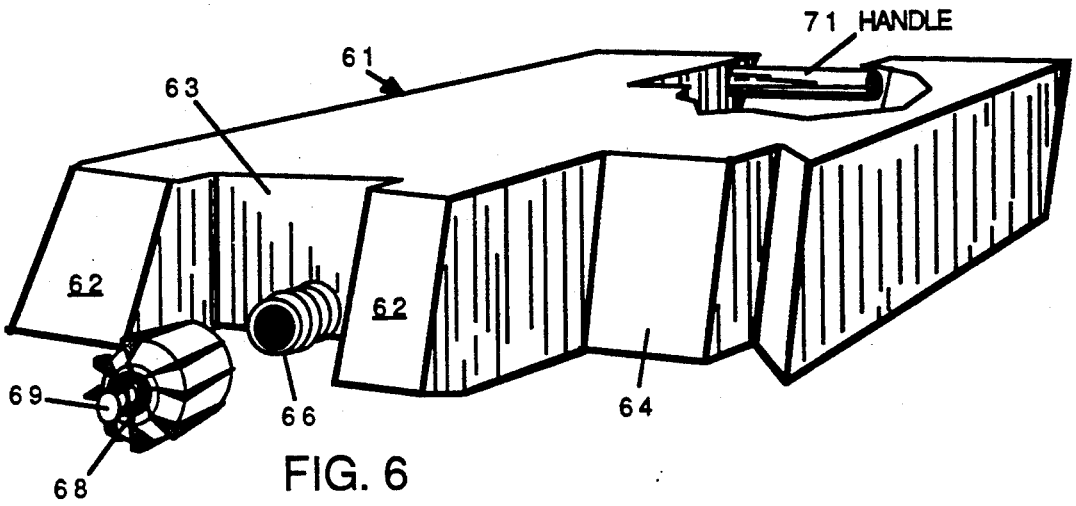
FIG. 6 is a perspective view of a liquid tank used in the humidifier shown in FIGS. 1-5.

Retained in a lower portion of the housing 12 below the lower trough 32 is a removable container 51 that defines a reservoir 52 for a supply of liquid such as water. Formed on opposite sidewalls of the container 51 are aligned support shoulders 53, 54 that slope downwardly toward a rear wall 56. A vertical ridge 57 projects inwardly from the rear wall 56 and defines an actuator surface 58. Removably supported on the support shoulders 53, 54 is a tank 61 that slopes downwardly therewith. As shown most clearly in FIG. 6, the tank 61 has a bottom wall 62 that defines a valve recess 63 and a pump recess 64. Formed in the bottom wall 62 within the valve recess 63 is an externally threaded spout 66 that can be used to fill the tank 61 with liquid. A cap 67 for the spout 66 retains a conventional check valve 68 having an outwardly projecting actuator stem 69. With the tank 61 in a fully inserted position on the container 51 as shown in FIG. 4, the vertical ridge 57 on the rear wall 56 is accommodated by the valve recess 63 and the actuator stem 69 forcibly engages the actuator surface 58. A handle 71 extends between outer sidewall portions of the tank 61. Access to the removable container 51 and the removable tank 61 is provided with the door 23 in an open position as shown in FIG. 4.

A pump assembly 73 is retained in the lower portion of the housing 12 below the upper and lower troughs 31, 32. Pivotably supporting the pump assembly 73 from the rear wall 16 of the housing 12 is a pivot pin 75. The pump assembly 73 includes a liquid pump 76 disposed near the bottom of the container 51 and a conventional float mechanism 77 adapted to move upwardly and downwardly in response to changes in the level of the liquid within the reservoir 52. Operably coupled to the float mechanism 77 is an electrical on/off switch 78 connected between the electrical motor 44 and the electrical control section 45. The pump assembly 73 is accommodated by the pump recess 64 in the tank 61.

As shown in FIG. 5, a first feed tube 81 has one end attached to an outlet of the pump 76 and an opposite end opening into a collection vessel 82 in the upper portion of the housing 12 adjacent to the tray 47. Liquid fed into the collection vessel 82 drains through an outlet tube 83 in the bottom thereof into a feed chamber 80. Providing liquid communication between outlet tube 83 in the bottom of the collection vessel 82 and the upper trough is a second feed tube 84.

A drain tube 85 has a bottom end disposed in the lower trough 32 and an upper end attached to an upper overflow tube 86 that projects upwardly into the upper trough 31. Similarly, a discharge tube 88 has a bottom end disposed in the container 51 and an upper end attached to a lower overflow tube 89 projecting upwardly into the lower trough 32.

Figure 3:
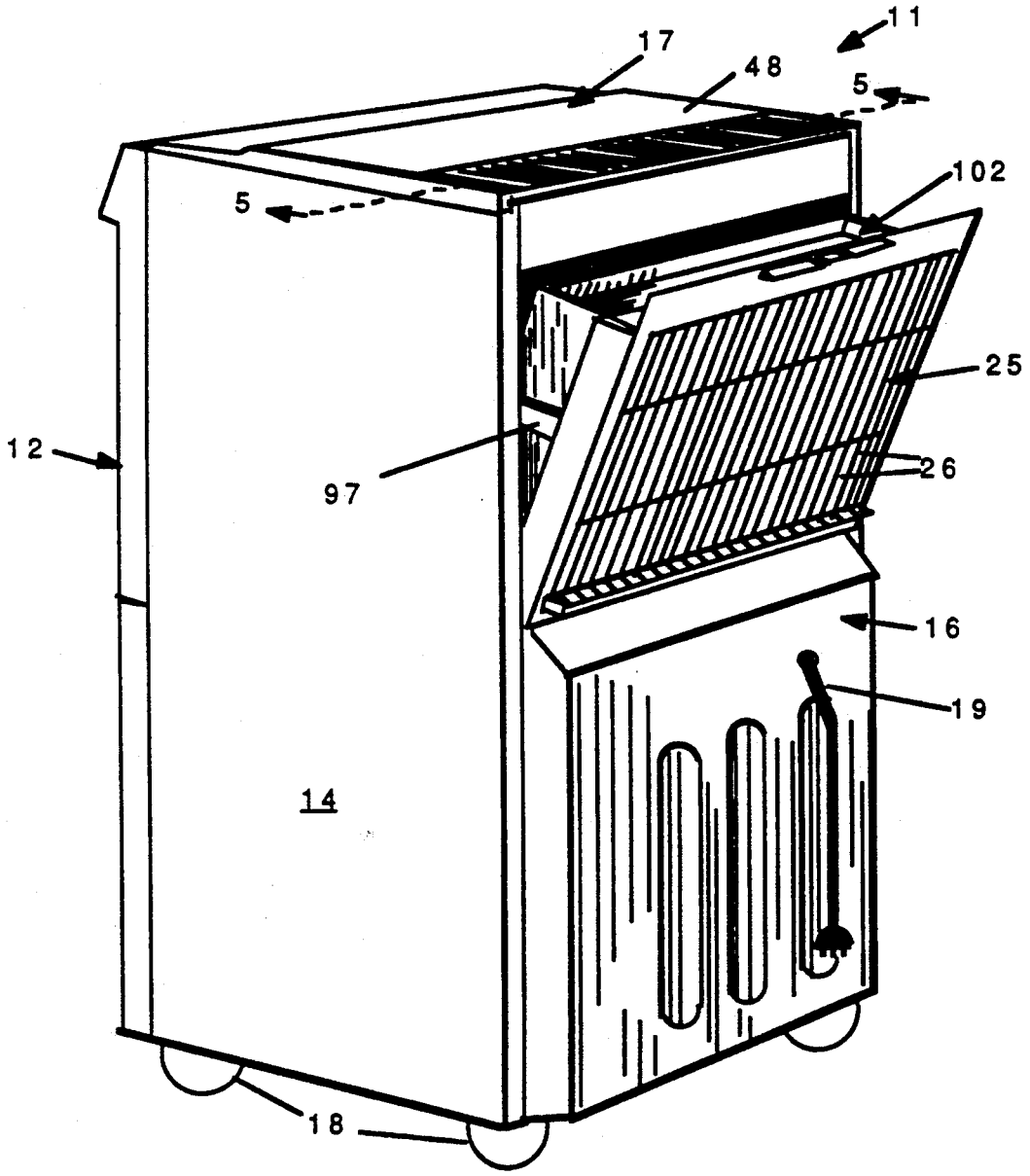
FIG. 3 is a rear perspective view of the humidifier shown in FIGS. 1 and 2.
Figure 7:
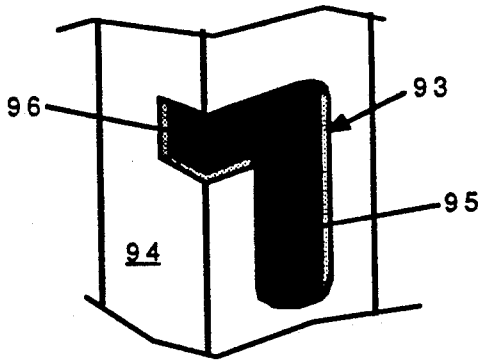
FIGS. 7 and 8 are detailed views of a coupling for removal of a wick cartridge used with the humidifier shown in FIGS. 1-5.
Figure 8:
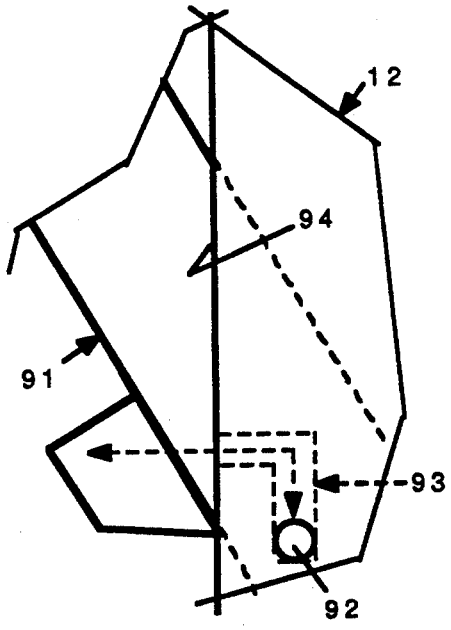

The outlet portion 25 of the rear sidewall 16, the upper and lower troughs 31, 32 and the upper and lower wick cartridges 34, 38 retained thereby constitute a integral unit 91 that is pivotably supported by the housing 12. As shown in FIGS. 7 and 8, each side of the unit 91 has outwardly projecting spindles 92 that are received by bayonet type openings 93 formed in straddling portions 94 of the housing 12. Each of the openings 93 includes a vertical slot portion 95 and a horizontal slot portion 96. The spindles 92 are pivotably retained at the bottom of the vertical slots 95 and permit pivotal movement of the unit 91 between a closed position shown in FIGS. 4 and an open position shown in FIG. 3. Resilient tabs 97 projecting outwardly from the sides of the unit 91 engage the edges of the housing portions 94 to retain the unit 91 in its open position shown in FIG. 3. However, by moving the spindles 92 upwardly in the vertical slots 95 to provide access to the horizontal slots 96 and forcing the resilient tabs 97 by the housing portions 94 the unit 91 can be fully separated from the housing 12.

OPERATION

Prior to use of the evaporator 11, the tank 61 is removed through the opened door 23 and filled with liquid through the filling spout 66 after removal of the cap 67. After replacement of the cap 67 on the spout 66, the tank 61 is inserted through the opened door 23 onto the support shoulders 53, 54 on the container 51. Upon full insertion of the tank 61, the actuator stem 69 forcibly engages the actuator surface 58 to open the valve 68 and produce discharge of the liquid within the tank 61 into the container 51. A given minimum liquid level within the container 51 moves the float mechanism 77 upwardly to close the switch 78 and permit energization of the fan motor 44 and the pump 76 in response to selective manipulation of the electrical control section 45.

Energization of the pump 76 produces liquid flow out of the reservoir 52 through the first feed tube 81, the collection vessel 82 and the second feed tube 84 into the upper trough 31. That liquid flow establishes a predetermined liquid volume in the upper trough 31 as determined by the height of the open upper end of the upper overflow tube 86. Additional liquid flow into the upper trough 31 is fed by gravity through the drain tube 85 into the lower trough 32 to establish therein a given liquid volume determined by the open upper end of the lower overflow tube 89. Additional liquid flow into the lower trough 32 is returned by gravity through the overflow tube 89 and the discharge tube 88 into the reservoir 52.

Water retained in the upper trough 31 saturates the source portion 35 of the upper wick cartridge 34 and capillary action produces migration of that liquid into the upper evaporative portion 36. Similarly, liquid retained in the lower trough 32 saturates the source portion 39 of the lower wick cartridge 38 and that liquid flows upwardly into the lower evaporative portion 41. Air flow provided by the rotating fan 43 moves air in through the inlet 21, the evaporative portions 36, 41 of respectively, the wick cartridges 34, 38 and the outlet 25. The liquid evaporated from the wick cartridges 34, 38 is transferred by the moving air into the surrounding environment to cause humidification thereof.

If environmental cooling in addition to humidification is desired, the tray 47 can be filled with ice through the opened lid 48. Cold liquid produced by melting of the ice in the tray 47 is fed by gravity through a drain opening 101 in the tray 47 into a transfer trough 102 disposed directly above the upper wick cartridge 34. Drain slots 103 in the bottom of the transfer trough 102 allow gravity induced flow of cooling liquid through the drain slots 103 into the upper evaporative portion 36 of the upper wick cartridge 34. Accordingly, air flow produced by the fan 43 through the upper evaporative portion 36 of the upper wick cartridge 34 is both cooled and humidified.

For purposes of cleaning, it is sometimes desirable to remove the container 51 from the housing 12. In that event, the tank 61 is removed through the opened door 23, and the pump assembly 73 is pivoted into an upright position above the rearwall 56 of the container 51 as shown by dashed lines in FIG. 5. The container 51 then can be removed through the opened door 23.

Obviously, many modifications and variations of the present invention are possible in light of the above teachings. It is to be understood, therefore, that the invention can be practiced otherwise than as specifically described.

What is claimed is:

1. Evaporator apparatus comprising:

portable housing means defining an air inlet, an air outlet, and a reservoir adapted to retain a liquid supply;

electrical blower means mounted in said housing means and adapted to produce air flow in a path between said inlet and said outlet;

vessel means retained by said housing means above said reservoir and adapted to retain a liquid volume;

wick means retained by said vessel and comprising a source portion submerged in said liquid volume and an evaporative portion disposed in said path so as to be contacted by air flowing between said inlet and said outlet, said wick means adapted to provide by capillary action liquid flow from said source portion to said evaporative portion; and electrical pump means mounted in said housing and adapted to pump liquid from said reservoir to said vessel means so as to maintain said liquid volume therein.

2. Evaporator apparatus according to claim 1 wherein said vessel means comprises a lower vessel retained by said housing means above said reservoir and adapted to retain a given portion of said liquid volume, and an upper vessel retained by said housing means above said lower vessel and adapted to retain a predetermined portion of said liquid volume; and said wick means comprises a lower wick means comprising a lower source portion submerged in said given portion and a lower evaporative portion disposed in said path, and an upper wick means comprising an upper source portion submerged in said predetermined portion and an upper evaporative portion disposed in said path.

3. Evaporator apparatus according to claim 2 wherein said pump means comprises feed tube means for circulating liquid from said reservoir to said upper vessel, said upper vessel defines upper overflow means for discharging by gravity liquid into said lower vessel so as to maintain said predetermined portion in said upper vessel, and said lower vessel defines lower overflow means for discharging liquid by gravity into said reservoir so as to maintain said given portion in said lower vessel.

4. Evaporator apparatus according to claim 1 wherein said housing means comprises an outlet sidewall having outlet openings defining said outlet, said outlet sidewall is adapted for pivotal movement between open and closed positions, and said vessel means is supported by said outlet sidewall for pivotal movement therewith.

5. Evaporator apparatus according to claim 4 wherein said vessel means comprises a lower vessel retained by said housing means above said reservoir and adapted to retain a given portion of said liquid volume, and an upper vessel retained by said housing above said lower vessel and adapted to retain a predetermined portion of said liquid volume; and said wick means comprises a lower wick means comprising a lower source portion submerged in said given portion and a lower evaporative portion disposed in said path, and an upper wick means comprising an upper source portion submerged in said predetermined portion and an upper evaporative portion disposed in said path.

6. Evaporator apparatus according to claim 5 wherein said pump means comprises feed tube means for circulating liquid from said reservoir to said upper vessel, said upper vessel defines upper overflow means for discharging by gravity liquid into said lower vessel so as to maintain said predetermined portion in said upper vessel, and said lower vessel defines lower overflow means for discharging liquid by gravity into said reservoir so as to maintain said given portion in said lower vessel.

7. Evaporator apparatus according to claim 6 wherein said outlet sidewall, said upper vessel and said lower vessel are removable as a unit from said housing means.

8. Evaporator apparatus according to claim 1 wherein said housing means further defines tray means disposed above said vessel and drain means providing liquid communication between said tray means and said evaporative portion of said wick means.

9. Evaporator apparatus according to claim 8 wherein said housing means comprises a top wall covering said tray means and adapted for movement into an open position so as to provide access thereto.

10. Evaporator apparatus according to claim 9 wherein said vessel means comprises a lower vessel retained by said housing means above said reservoir and adapted to retain a given portion of said liquid volume, and an upper vessel retained by said housing means above said lower vessel and adapted to retain a predetermined portion of said liquid volume; and said wick means comprises a lower wick means comprising a lower source portion submerged in said given portion and a lower evaporative portion disposed in said path, and an upper wick means comprising an upper source portion submerged in said predetermined portion and an upper evaporative portion disposed in said path.

11. Evaporator apparatus according to claim 1 wherein said housing means further comprises a container defining said reservoir and a sidewall door providing access thereto.

12. Evaporator apparatus according to claim 11 including a removable tank accessible through said sidewall door and adapted for filling with liquid, and valve means for discharging liquid retained by said tank; and said housing means further comprises support means for supporting said tank in a position producing liquid discharge from said valve means into said container.

13. Evaporator apparatus according to claim 12 wherein said valve means comprises a check valve having an actuator stem, and said housing means further defines an actuator surface disposed to engage said actuator stem and induce discharge of liquid retained by said tank.

14. Evaporator apparatus according to claim 13 wherein said tank comprises a bottom wall retaining said check valve with said actuator stem projecting outwardly therefrom, and said support means is shaped and arranged to support said tank in an inclined position with said bottom wall facing downwardly.

15. Evaporator apparatus according to claim 14 wherein said support means and said actuator surface are defined by said container.

16. Evaporator apparatus according to claim 15 wherein said support means comprises shoulders disposed on opposite side walls of said container and sloping downwardly toward a rear wall thereof, and said rear wall defines said actuator surface.

17. Evaporator apparatus according to claim 11 wherein said container is removable, said pump means comprises a pump pivotally supported in said container by said housing means and pivotable into a position out of said container so as to permit removal thereof through said side wall door.

18. Evaporator apparatus according to claim 11 wherein said pump means further comprises switch means functional to either energize or deenergize said pump, float means operatively coupled to said switch means and pivotable with said pump, said float means operable to cause energization of said pump in response to a given minimum liquid level in said reservoir and to cause deenergization of said pump in response to either a level of liquid in said reservoir less than said given level or pivotal movement of said pump out of said container.

19. Evaporator apparatus according to claim 17 including a removable tank accessible through said sidewall door and adapted for filling with liquid, and valve means for discharging liquid retained by said tank; and said housing means further comprises support means for supporting said tank in a position producing liquid discharge from said valve means into said container.

20. Evaporator apparatus according to claim 19 wherein said valve means comprises a check valve having an actuator stem, and said housing means further defines an actuator surface disposed to engage said actuator stem and induce discharge of liquid retained by said tank.

21. Evaporator apparatus according to claim 20 wherein said tank comprises a bottom wall retaining said check valve with said actuator stem projecting outwardly therefrom, and said support means is shaped and arranged to support said tank in an inclined position with said bottom wall facing downwardly.

22. Evaporator apparatus according to claim 21 wherein said support means and said actuator surface are defined by said container.

23. Evaporator apparatus according to claim 22 wherein said support means comprises shoulders disposed on opposite side walls of said container and sloping downwardly toward a rear wall thereof, and said rear wall defines said actuator surface.

24. Evaporator apparatus according to claim 23 wherein said container is removable, said pump means comprises a pump pivotally supported in said container by said housing means and pivotable into a position out of said container so as to permit removal thereof through said sidewall door.

25. Evaporator apparatus according to claim 24 wherein said bottom wall of said tank defines a recess accommodating said pump.

26. Evaporator apparatus according to claim 25 wherein an end of said tank opposite to said bottom wall defines a handle.

27. Evaporator apparatus comprising:

housing means defining an air inlet, an air outlet, a sidewall door, tank support means, and a container defining a reservoir adapted to retain a liquid supply;

blower means for producing air flow in a path between said inlet and said outlet;

wick means retained by said housing means and comprising a source portion adapted to receive liquid from said reservoir and an evaporative portion disposed in said path so as to be contacted by air flowing between said inlet and said outlet, said wick means adapted to provide by capillary action liquid flow from said source portion to said evaporative portion;

a removable tank retained by said support means and accessible through said door and adapted for filling with liquid; and valve means for discharging liquid retained by said tank, and wherein said tank is supported by said support means in a position producing liquid discharge from said valve means into said container.

28. Evaporator apparatus according to claim 27 wherein said valve means comprises a check valve having an actuator stem, and said housing means further defines an actuator surface disposed to engage said actuator stem and induce discharge of liquid retained by said tank.

29. Evaporator apparatus according to claim 28 wherein said tank comprises a bottom wall retaining said check valve with said actuator stem projecting outwardly therefrom, and said support means is shaped and arranged to support said tank in an inclined position with said bottom wall facing downwardly.

30. Evaporator apparatus comprising:

housing means defining an air inlet, an air outlet, and a reservoir adapted to retain a liquid supply;

blower means for producing air flow in a path between said inlet and said outlet;

a lower vessel retained by said housing means above said reservoir and adapted to retain a given portion of said liquid volume and said lower vessel defining lower overflow means for discharging liquid by gravity into said reservoir so as to maintain said given portion in said lower vessel;

an upper vessel retained by said housing means above said lower vessel and adapted to retain a predetermined portion of said liquid volume, said upper vessel defining upper overflow means for discharging by gravity liquid into said lower vessel so as to maintain said predetermined portion in said upper vessel;

a lower wick means comprising a lower source portion submerged in said given portion and a lower evaporative portion disposed in said path;

an upper wick means comprising an upper source portion submerged in said predetermined portion and an upper evaporative portion disposed in said path; and pump means including feed tube means for circulating liquid from said reservoir to said upper vessel.

31. Evaporator apparatus according to claim 30 wherein said pump means comprises a pump mounted in said reservoir, feed tube means extending between said pump and said upper vessel, an upper drain tube extending between said upper overflow means and said lower vessel, and a discharge tube extending between said lower overflow means and said reservoir.

32. Evaporator apparatus according to claim 31 wherein said housing means further defines a collection vessel disposed adjacent to said tray means, and said feed tube means comprises a first tube extending between said pump and said collection vessel and a second tube extending between said collection vessel and said upper vessel.

33. Evaporator apparatus according to claim 32 wherein said housing means comprises an outlet sidewall having openings defining said outlet, said outlet sidewall is adapted for pivotal movement between open and closed positions, and said vessel means is supported by said outlet sidewall for pivotal movement therewith.

34. Evaporator apparatus according to claim 33 wherein said outlet sidewall, said upper vessel and said lower vessel are removable as a unit from said housing means.

* * * * *